US008272719B2

(12) United States Patent
Inoue et al.

(10) Patent No.: US 8,272,719 B2
(45) Date of Patent: Sep. 25, 2012

(54) LIQUID DROPLET JETTING APPARATUS AND IMAGE FORMING APPARATUS

(75) Inventors: Hiroshi Inoue, Kanagawa (JP); Tetsuzo Kadomatsu, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 388 days.

(21) Appl. No.: 12/715,408

(22) Filed: Mar. 2, 2010

(65) Prior Publication Data

US 2010/0245494 A1 Sep. 30, 2010

(30) Foreign Application Priority Data

Mar. 30, 2009 (JP) ..... 2009-083056

(51) Int. Cl.
*B41J 2/175* (2006.01)

(52) U.S. Cl. ..... 347/85

(58) Field of Classification Search ..... 347/84, 347/85, 89, 92, 49
See application file for complete search history.

(56) References Cited

U.S. PATENT DOCUMENTS 5,771,052 A * 6/1998 Hine et al. ..... 347/49
7,901,063 B2 * 3/2011 Wouters et al. ..... 347/89

FOREIGN PATENT DOCUMENTS

JP 2-283457 A 11/1990

* cited by examiner

*Primary Examiner* — Kristal Feggins
(74) *Attorney, Agent, or Firm* — SOLARIS Intellectual Property Group, PLLC

(57) ABSTRACT

A liquid droplet jetting apparatus includes a jetting unit equipped with plural head modules, a supply channel equipped with plural branching channels, first circulation limiting units, liquid storage units and external force applying units. The first circulating limiting units allow circulation of a liquid in a direction from a storage chamber to each of the head modules and limit circulation of the liquid in an opposite direction of the circulating direction. The liquid storage units are disposed between the circulation limiting units and the head modules. The liquid storage units store the liquid, and the volumes of the liquid storage units change due to external force. The external force applying units apply the external force to the liquid storage units such that the volumes of the liquid storage units become smaller and cause liquid droplets to be jetted from the nozzles.

7 Claims, 7 Drawing Sheets

LIQUID DROPLET JETTING APPARATUS AND IMAGE FORMING APPARATUS

CROSS-REFERENCE TO RELATED APPLICATION

This application claims priority under 35 USC 119 from Japanese Patent Application No. 2009-083056 filed on Mar. 30, 2009, the disclosure of which is incorporated by reference herein.

BACKGROUND OF THE INVENTION

1. Field of the Invention

The present invention relates to a liquid droplet jetting apparatus that jets liquid droplets from nozzles and an image forming apparatus.

2. Description of the Related Art

In recent years, liquid droplet jetting apparatus that form dots configuring an image on a recording medium by jetting liquid droplets from nozzles have become pervasive.

In this type of liquid droplet jetting apparatus, the jetted state of the liquid droplets changes and the image quality of the image that is formed deteriorates because of changes in the characteristics of the liquid filling the pressure chambers.

In Japanese Patent Application Laid-Open Publication (JP-A) No. 2-283457, there is disclosed an inkjet apparatus including: a container that is connected to a liquid droplet jetting mechanism and temporarily stores a liquid; and a pressure pawl that contacts a pressure rubber attached to part of a wall surface of the container to cause liquid droplets inside the container to be jetted to thereby cause the liquid to be discharged from a distal end of a print head (head module).

However, the aforementioned technology is not compatible with an apparatus configuration that is equipped with plural head modules like in an inkjet line head and distributes and supplies a liquid with respect to the plural head modules from one liquid (ink) supply source.

SUMMARY OF THE INVENTION

The present invention has been made in view of the above circumstances and provides a liquid droplet jetting apparatus and an image forming apparatus.

According to an aspect of the invention, there is provided there is provided a liquid droplet jetting apparatus comprising: a jetting unit equipped with plural head modules, each of the plural head modules including plural nozzles that jet liquid droplets and plural pressure chambers that jet a supplied liquid from the nozzles in response to applied pressure; a supply channel equipped with plural branching channels that supply, to each of the plural head modules, liquid that is stored in a storage chamber that stores the liquid; first circulation limiting units that are disposed in each of the plural branching channels, that allow circulation of the liquid in a direction from the storage chamber to the plural head modules and that limit circulation of the liquid in an opposite direction of the circulating direction; liquid storage units that are disposed between the circulation limiting units in each of the plural branching channels and the plural head modules, that store the liquid, and whose volumes change because of external force; and external force applying units that apply the external force to the liquid storage units, such that the volumes of the liquid storage units become smaller, and that cause liquid droplets to be jetted from the nozzles.

BRIEF DESCRIPTION OF THE DRAWINGS

A preferred embodiment of the present invention will be described in detail based on the following figures, wherein.

DETAILED DESCRIPTION OF THE INVENTION

The present invention provides a liquid droplet jetting apparatus that is equipped with plural head modules and can perform maintenance to discharge liquid into which air bubbles and foreign matter have become mixed for each head module with a simple configuration.

An embodiment of the present invention will be described in detail below with reference to the drawings. In the present embodiment, the liquid droplet jetting apparatus pertaining to the present invention will be applied to an image forming apparatus and described.

The overall configuration of an image forming apparatus 10 pertaining to the present embodiment will be described with reference to FIG. 1.

Figure 1:
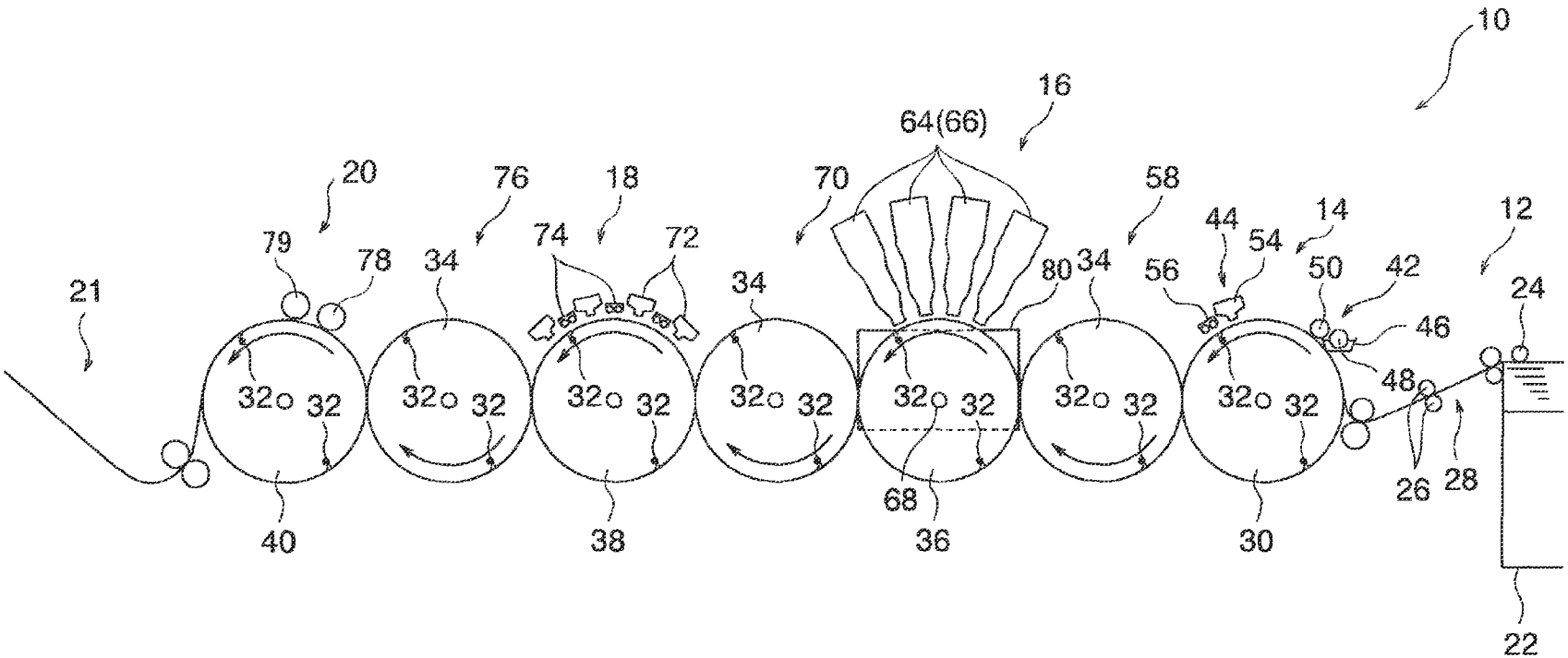
FIG. 1 is a side view showing the configuration of an image forming apparatus pertaining to the embodiment.

As shown in FIG. 1, in the image forming apparatus 10 pertaining to the present embodiment, a paper feeding and conveying unit 12 that feeds and conveys sheets of paper (hereinafter called "the paper") serving as a recording medium is disposed upstream in a conveyance direction of the paper. Downstream of the paper feeding and conveying unit 12, there are disposed, along the conveyance direction of the paper, a processing solution applying unit 14 that applies a processing solution to a recording surface of the paper, an image forming unit 16 that forms an image with ink liquid on the recording surface of the paper, an ink drying unit 18 that dries the image that has been formed on the recording surface, an image fixing unit 20 that fixes the dried image to the paper, and a discharging unit 21 that discharges the paper to which the image has been fixed.

Each processing unit will be described below.

(Paper Feeding and Conveying Unit)

In the paper feeding and conveying unit 12, there is disposed a loading unit 22 into which the paper is loaded. Downstream of the loading unit 22 in the conveyance direction of the paper (hereinafter, sometimes "the conveyance direction of the paper" will be omitted), there is disposed a paper feeding unit 24 that feeds, one sheet at a time, the paper that has been loaded into the loading unit 22. The paper that has been fed by the paper feeding unit 24 is conveyed to the processing solution applying unit 14 via a conveying unit 28 that is configured by plural pairs of rollers 26.

(Processing Solution Applying Unit)

In the processing solution applying unit 14, there is rotatably disposed a processing solution applying drum 30 that is configured by a cylindrical member around whose outer peripheral surface the paper is wrapped and which conveys the paper by rotating. On the processing solution applying drum 30, there is disposed a holding member 32 that holds the leading end portion of the paper between itself and the processing solution applying drum 30 to thereby hold the paper, and in a state where the paper is held on the surface of the processing solution applying drum 30 via the holding member 32, the paper is conveyed downstream by the rotation of the processing solution applying drum 30.

Intermediate conveying drums 34, an image forming drum 36, an ink drying drum 38 and an image fixing drum 40 that will be described later are also configured in the same manner as the processing solution applying drum 30, and a holding member 32 is disposed on each. Delivery of the paper from an upstream drum to a downstream drum is performed by the holding member 32.

On the upper portion of the processing solution applying drum 30, a processing solution applying device 42 and a processing solution drying device 44 are disposed along the circumferential direction of the processing solution applying drum 30. The processing solution is applied to the recording surface of the paper by the processing solution applying device 42. The processing solution is dried by the processing solution drying device 44.

Here, the processing solution has the effect that it reacts with the ink to agglutinate the color material (pigment) and promotes separation of the color material (pigment) and the solvent. In the processing solution applying device 42, there is disposed a storage unit 46 in which the processing solution is stored, and part of a gravure roller 48 is immersed in the processing solution.

A rubber roller 50 is disposed in pressure-contact with the gravure roller 48, and the rubber roller 50 contacts the recording surface (front surface) side of the paper such that the processing solution is applied thereto. A squeegee (not shown) contacts the gravure roller 48 and controls the amount of the processing solution that is applied to the recording surface of the paper.

It is ideal for the processing solution film thickness to be sufficiently smaller than head-jetted liquid droplets (ink droplets). For example, in the case of a 2-pl jetting amount, the average diameter of head-jetted liquid droplets is 15.6 μm, and when the processing solution film thickness is thick, the ink dots float in the processing solution without contacting the recording surface of the paper. In order to obtain a landing dot diameter of 30 μm or greater with a 2-pl jetting amount, it is preferred to make the processing solution film thickness 3 μm or less.

In the processing solution drying device 44, a hot-air nozzle 54 and an infrared heater 56 (hereinafter called "the IR heater 56") are disposed near the surface of the processing solution applying drum 30. The solvent such as water in the processing solution is evaporated by the hot-air nozzle 54 and the IR heater 56 to form a solid or thin-film processing solution layer on the recording surface side of the paper. By making the processing solution into a thin film in the processing solution drying step, dots obtained as a result of the ink droplets being jetted in the image forming unit 16 contact the paper surface such that the necessary dot diameter is obtained, and it is easy to obtain action where the ink reacts with the processing solution that has been made into a thin film to agglutinate the color material and the ink solidifies on the paper surface.

The paper onto whose recording surface the processing solution has been applied and dried in the processing solution applying unit 14 in this manner is conveyed to an intermediate conveying unit 58 that is disposed between the processing solution applying unit 14 and the image forming unit 16.

(Intermediate Conveying Unit)

In the intermediate conveying unit 58, there is rotatably disposed an intermediate conveying drum 34. The paper is held on the surface of the intermediate conveying drum 34 via the holding member 32 that is disposed on the intermediate conveying drum 34, and the paper is conveyed downstream by the rotation of the intermediate conveying drum 34.

(Image Forming Unit)

In the image forming unit 16, there is rotatably disposed an image forming drum 36. The paper is held on the surface of the image forming drum 36 via the holding member 32 that is disposed on the image forming drum 36, and the paper is conveyed downstream by the rotation of the image forming drum 36.

On the upper portion of the image forming drum 36, a head unit 66 configured by single-pass inkjet line heads 64 is disposed near the surface of the image forming drum 36. In the head unit 66, inkjet line heads 64 of at least YMCK, which are basic colors, are arrayed along the circumferential direction of the image forming drum 36, and images of each color are formed on the processing solution layer that has been formed on the recording surface of the paper in the processing solution applying unit 14.

The processing solution has the effect of agglutinating, to the processing solution, the color material (pigment) and latex particles dispersed in the ink, and the processing solution forms an aggregate where color material flow or the like does not occur on the paper. As one example of the reaction between the ink liquid and the processing solution, an acid is included in the processing solution, a mechanism that destroys pigment dispersion and agglutinates the pigment by lowering PH is used, and jetting interference resulting from color material running, color mixing between each color ink and liquid union when the ink droplets land is avoided.

The inkjet line heads 64 perform jetting synchronously with an encoder (not shown) that is disposed on the image forming drum 36 and detects its rotational speed. Thus, the inkjet line heads 64 are capable of determining landing positions with high accuracy and reducing jetting unevenness independent of the vibration of the image forming drum 36, the accuracy of a rotating shaft 68 and the drum surface speed.

A maintenance unit 80 is disposed adjacent to the image forming unit 16 along the axial direction of the image forming drum 36. The maintenance unit 80 performs maintenance operation such as cleaning nozzle surfaces of the inkjet line heads 64 and discharging sticky ink. The maintenance unit 80 is equipped with a waste solution tray that collects discharge ink resulting from dummy jetting, which is jetting that differs from normal ink droplet jetting.

(Ink Drying Unit)

In the ink drying unit 18 shown in FIG. 1, there is rotatably disposed an ink drying drum 38. On the upper portion of the ink drying drum 38, plural hot-air nozzles 72 and plural IR heaters 74 are disposed near the surface of the ink drying drum 38. Because of the hot air resulting from the hot-air nozzles 72 and the IR heaters 74, the solvent that has been separated by the color material agglutination action is dried and a thin-film image layer is formed in an image formation region of the paper.

The temperature of the hot air differs depending on the conveyance speed of the paper. Ordinarily, the temperature of the hot air is set to 50° C. to 70° C. The evaporated solvent is discharged to the outside of the image forming apparatus 10 together with air. The air is recovered. The air may be cooled by a cooler/radiator or the like and recovered as ink liquid.

The paper on whose recording surface the image has dried is conveyed by the rotation of the ink drying drum 38 to an intermediate conveying unit 76 that is disposed between the ink drying unit 18 and the image fixing unit 20. Description of the intermediate conveying unit 76 will be omitted because its configuration is substantially the same as that of the intermediate conveying unit 58.

(Image Fixing Unit)

In the image fixing unit 20, there is rotatably disposed an image fixing drum 40, and the image fixing unit 20 has a function where the latex particles in the thin image layer that has been formed on the ink drying drum 38 are heated and pressurized such that the latex particles melt and become anchored and fixed onto the paper.

On the upper portion of the image fixing drum 40, a heat roller 78 is disposed near the surface of the image fixing drum 40. The heat roller 78 is configured by a metal pipe made of aluminum or the like that has good thermal conductivity and a halogen lamp that is incorporated inside the metal pipe. Thermal energy equal to or greater than a Tg temperature of the latex is applied by the heat roller 78. Thus, the heat roller 78 melts the latex particles and pushes the latex particles into uneven portions of the paper to perform fixing and also levels unevenness in the image surface to make it possible to obtain glossiness.

Downstream of the heat roller 78, there is disposed a fixing roller 79. The fixing roller 79 is disposed in a state where it is in pressure-contact with the surface of the image fixing drum 40 such that a nipping force is obtained between the fixing roller 79 and the image fixing drum 40. For this reason, at least one of the fixing roller 79 and the image fixing drum 40 has an elastic layer on its surface and has an even nip width with respect to the paper.

Because of the step described above, the paper on whose recording surface the image has been fixed is conveyed by the rotation of the image fixing drum 40 to the discharge unit 21 that is disposed downstream of the image fixing unit 20.

Figure 2:
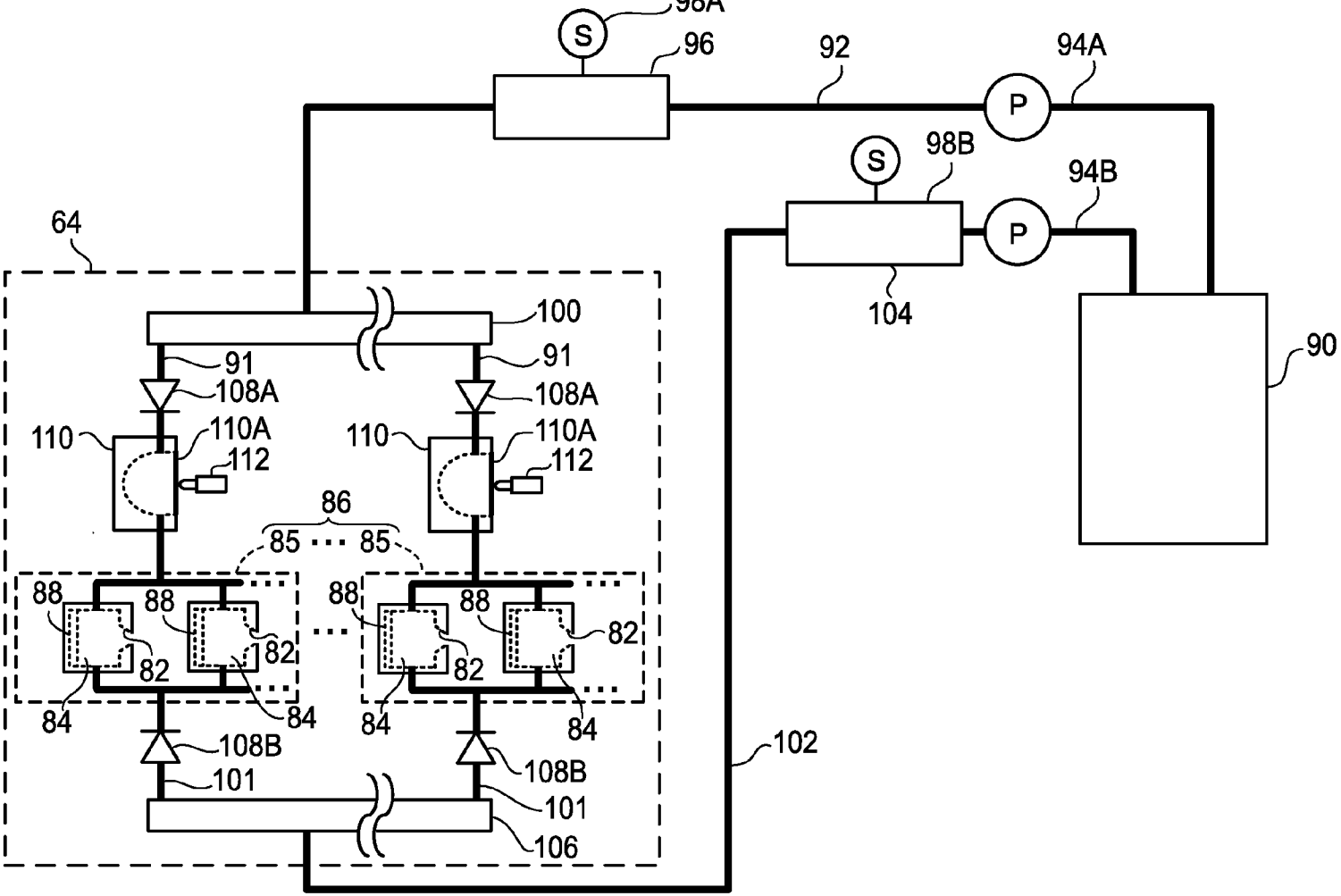
FIG. 2 is a schematic diagram showing the configuration of an inkjet line head pertaining to the embodiment and a flow channel for ink liquid that is supplied from an ink tank to the inkjet line head.

In FIG. 2, there is schematically shown the configuration of the inkjet line head 64 and a supply path by which the ink liquid is supplied to the inkjet line head 64.

The inkjet line head 64 pertaining to the present embodiment is equipped with a jetting unit 86 equipped with plural head modules 85, each of which includes plural (e.g., several hundred) pressure chambers 84 having nozzles 82 that jet ink droplets and jetting the supplied ink liquid from the nozzles 82 in response to applied pressure.

Actuators 88 that apply pressure to each of the plural pressure chambers 84 are joined to surfaces of parts of the plural pressure chambers 84 (surfaces corresponding to the surfaces in which the nozzles 82 are disposed). The actuators 88 deform as a result of a drive voltage being applied thereto, whereby the actuators 88 cause the volumes of the pressure chambers 84 to change and cause ink droplets to be jetted from the nozzles 82 because of the pressure change accompanying this. Piezoelectric elements that use piezoelectric bodies made of lead zirconate titanate or barium titanate are suitably used for the actuators 88. When displacement of the actuators 88 returns to normal after the ink droplets have been jetted, new ink is supplied to the pressure chambers 84.

FIG. 2 schematically shows the structure of the inkjet line head 64, so the array of the nozzles 82 differs from the actual array. In actuality, the nozzles 82 are two-dimensionally arrayed in the nozzle surface of the inkjet line head 64.

In the image forming apparatus 10 pertaining to the present embodiment, there is disposed a supply channel 92 equipped with plural branching channels 91 that supply, to each of the head modules 85, the ink liquid that is stored in an ink tank 90 that stores the ink liquid, and in the supply channel 92, there are disposed a pump 94A and an ink supply buffer tank 96.

The ink liquid stored in the ink tank 90 is delivered to the ink supply buffer tank 96 by the pump 94A and is supplied to each of the head modules 85 by the branching channels 91 that are branched by an ink supply manifold 100 inside the inkjet line head 64.

In the image forming apparatus 10 pertaining to the present embodiment, there is disposed a return path 102 with which plural discharge channels 101, through which the ink liquid that has been discharged from the head modules 85 circulates, are communicated and which allows the ink liquid that has been supplied to each of the head modules 85 to return to the ink tank 90. In the return channel 102, there are disposed an ink recovery buffer tank 104 and a pump 94B.

The ink liquid that has circulated through the discharge channels 101 is stored in the ink recovery buffer tank 104 via an ink recovery manifold 106 inside the inkjet line head 64 and is thereafter delivered to the ink tank 90 by the pump 94B.

In the ink supply buffer tank 96, the pressure of the ink liquid that the ink supply buffer tank 96 stores is detected by a pressure sensor 98A, and the pressure of the ink liquid is controlled such that it is adjusted to a predetermined pressure. In the ink recovery buffer tank 104 also, similarly, the pressure of the ink liquid that the ink recovery buffer tank 104 stores is detected by a pressure sensor 98B, and the pressure of the ink liquid is controlled such that it is adjusted to a predetermined pressure. In the image forming apparatus 10 pertaining to the present embodiment, circulation of the ink liquid inside the inkjet line head 64 is performed by a pressure difference between the ink liquid inside the ink supply buffer tank 96 and the ink liquid inside the ink recovery buffer tank 104.

The inkjet line head 64 pertaining to the present embodiment is equipped with circulation limiting values 108A, ink storage units 110 and push actuators 112. The circulation limiting valves 108A are disposed in each of the plural branching channels 91, allow circulation of the ink liquid in a direction from the ink tank 90 to the head modules 85 and limit circulation of the ink liquid in an opposite direction of the circulating direction. The ink storage units 110 are disposed between the circulation limiting valves 108A in each of the plural branching channels 91 and the head modules 85 and store the ink liquid, and the volumes of the ink storage units 110 change because of external force. The push actuators 112 apply the external force to the ink storage units 110, such that the volumes of the ink storage units 110 become smaller, and cause ink droplets to be jetted from the nozzles 82. The inkjet line head 64 pertaining to the present embodiment is equipped with circulation limiting valves 108B that are disposed in each of the plural discharge channels 101 and limit circulation of the ink liquid in a direction from the head modules 85 to the ink tank 90 when the external force is being applied to the ink storage units 110 by the push actuators 112. That is, in the inkjet line head 64 pertaining to the present embodiment, as shown in FIG. 2, a configuration comprising a set of the circulation limiting valve 108A, the ink storage unit 110, the head module 85 and the circulation limiting valve 108B is disposed in plural sets. The circulation limiting valves 108A correspond to first circulation limiting units, the circulation limiting valves 108B correspond to second circulation limiting units, the ink storage units 110 correspond to liquid storage units, and the push actuators 112 correspond to external force applying units.

Figure 3:
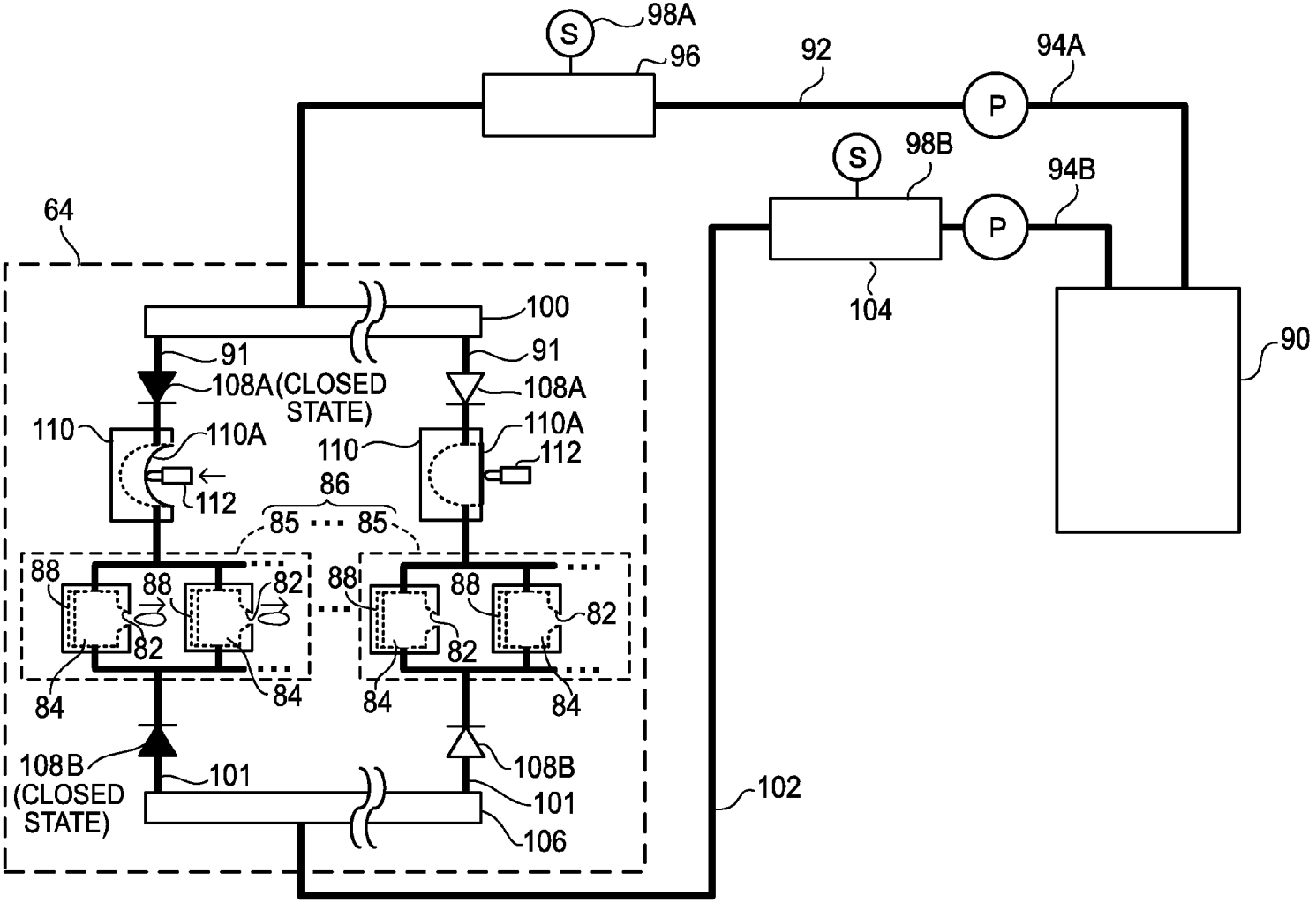
FIG. 3 is a schematic diagram showing a state where push actuators pertaining to the embodiment are applying external force to ink storage units.

The ink storage units 110 pertaining to the present embodiment have parts (hereinafter called "deforming portions 110A") that are flexible. The external force is applied to the deforming portions 110A by the push actuators 112, whereby, as shown in FIG. 3, the volumes of the ink storage units 110 become smaller, the ink liquid stored in the ink storage units 110 flows into the pressure chambers 84, and ink droplets are jetted from the nozzles 82. At this time, the circulation limiting valves 108A limit circulation of the ink liquid in the direction from the ink storage units 110 to the ink tank 90, and the circulation limiting valves 108B limit circulation of the ink liquid in the direction from the head modules 85 to the ink tank 90.

In the image forming apparatus pertaining to the present embodiment, elastic rubber films are used as the material configuring the deforming portions 110A of the ink storage units 110. However, the material is not limited to rubber films, and the deforming portions 110A may be configured by other flexible materials such as elastic resin films or elastomer films.

The push actuators 112 pertaining to the present embodiment move, as a result of solenoids being excited, in the direction of the deforming portions 110A from positions where the push actuators 112 do not apply the external force to the deforming portions 110A of the ink storage units 110, and the push actuators 112 apply the external force to the deforming portions 110A.

Figure 4A:
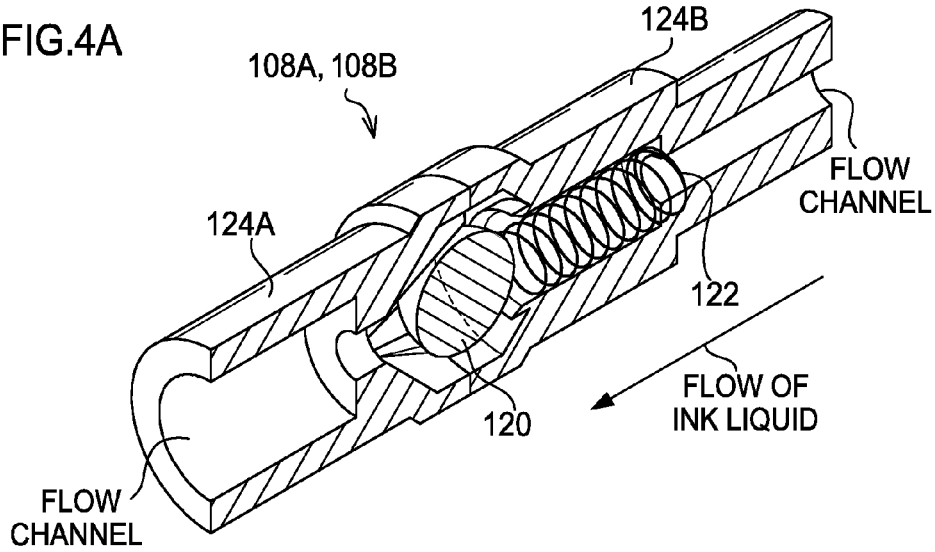
FIG. 4A to FIG. 4C are diagrams showing the configuration of a circulation limiting valve.
Figure 4B:
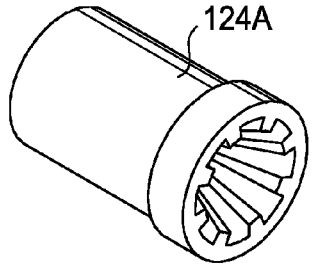
Figure 4C:
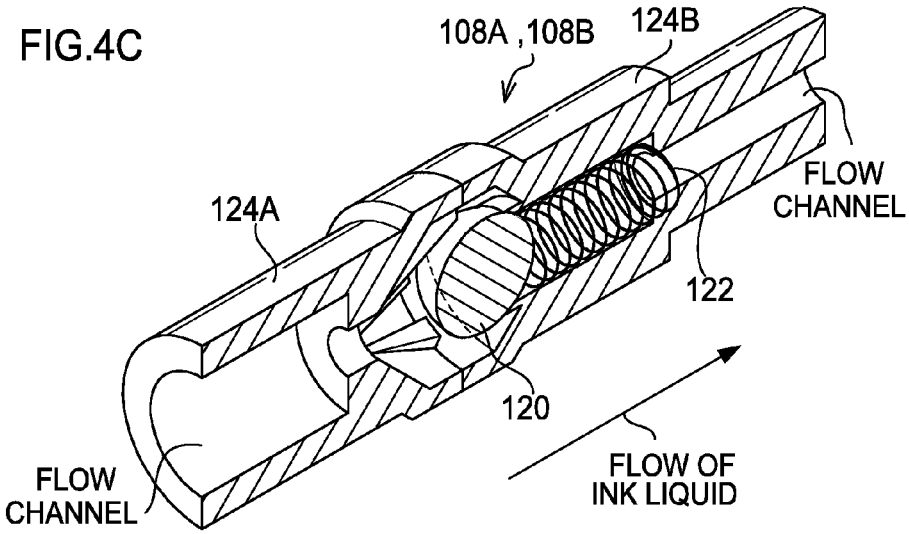

The shapes of the circulation limiting valves 108A and the circulation limiting valves 108B pertaining to the present embodiment are the same. FIG. 4A and FIG. 4C show cross-sectional views of the circulation valves 108A and 108B pertaining to the present embodiment.

The circulation limiting valves 108A and 108B are equipped with valve bodies 120 that open and close the flow channels of the ink liquid and energizing members 122 that energize the valve bodies 120. In the circulation limiting valves 108A and 108B pertaining to the present embodiment, the valve bodies 120 have spherical shapes as one example and springs are used for the energizing members 122 as one example. The energizing members 122 correspond to energizing units.

The state of the circulation limiting valves 108A and 108B shown in FIG. 4A is a state where the ink liquid is circulating therethrough (hereinafter called "the open state"). As shown in FIG. 4A, when the circulation limiting valves 108A and 108B are in the open state, the valve bodies 120 contact main bodies 124A because of the energizing force of the energizing members 122 disposed in the main bodies 124A. However, because the shapes of the flow channels in the main bodies 124A that contact the valve bodies 120 are, as shown in FIG. 4B, configured to be rib-shaped, there are gaps even when the main bodies 124A contact the valve bodies 120, and the ink liquid circulates through those gaps.

The state of the circulation limiting valves 108A and 108B shown in FIG. 4C is a state where circulation of the ink liquid is stopped (hereinafter called "the closed state"). When the circulation limiting valves 108A and 108B are in the closed state, the ink liquid flows in a direction from the main bodies 124A to main bodies 124B with pressure counter to the energizing force of the energizing members 122 and, as shown in FIG. 4C, the valve bodies 120 contact the main bodies 124B. At this time, circulation of the ink liquid is stopped because the shapes of the flow channels in the main bodies 124B that contact the valve bodies 120 are configured to be shapes corresponding to the shapes of the valve bodies 120 so that there are no gaps when the valve bodies 120 contact the main bodies 124B.

In this manner, the circulation limiting valves 108A and 108B pertaining to the present embodiment can passively open and close the flow channels because of the pressure of the ink liquid.

The circulation limiting valves 108A pertaining to the present embodiment are disposed in the branching channels 91 such that the main bodies 124B are on the side of the ink tank 90 and such that the main bodies 124A are on the side of the ink storage units 110. When the ink liquid flows from the ink tank 90 to the ink storage units 110, the valve bodies 120 are energized by the energizing members 122 in the direction in which the valve bodies 120 open the branching channels 91. When the ink liquid tries to circulate in the direction from the ink storage units 110 to the ink tank 90 counter to the energizing force of the energizing members 122, the valve bodies 120 close the branching channels 91. That is, the circulation limiting valves 108A act as check valves that prevent reverse flow of the ink liquid when the external force is applied to the ink storage units 110 by the push actuators 112.

The circulation limiting valves 108B pertaining to the present embodiment are disposed in the discharge channels 101 such that the main bodies 124A are on the side of the head modules 85 and such that the main bodies 124B are on the side of the ink tank 90. The valve bodies 120 are energized by the energizing members 122 in the direction in which the valve bodies 120 open the discharge channels 101, and the valve bodies 120 close the discharge channels 101 when the ink liquid tries to circulate through the discharge channels 101 with pressure that is stronger than the energizing force of the energizing members 12. That is, the circulation limiting valves 108B prevent the ink liquid from flowing into the ink tank 90 via the head modules 85 and prevent the ink liquid from flowing into other head modules 85 when the external force has been applied to the ink storage units 110 by the push actuators 112.

Figure 5:
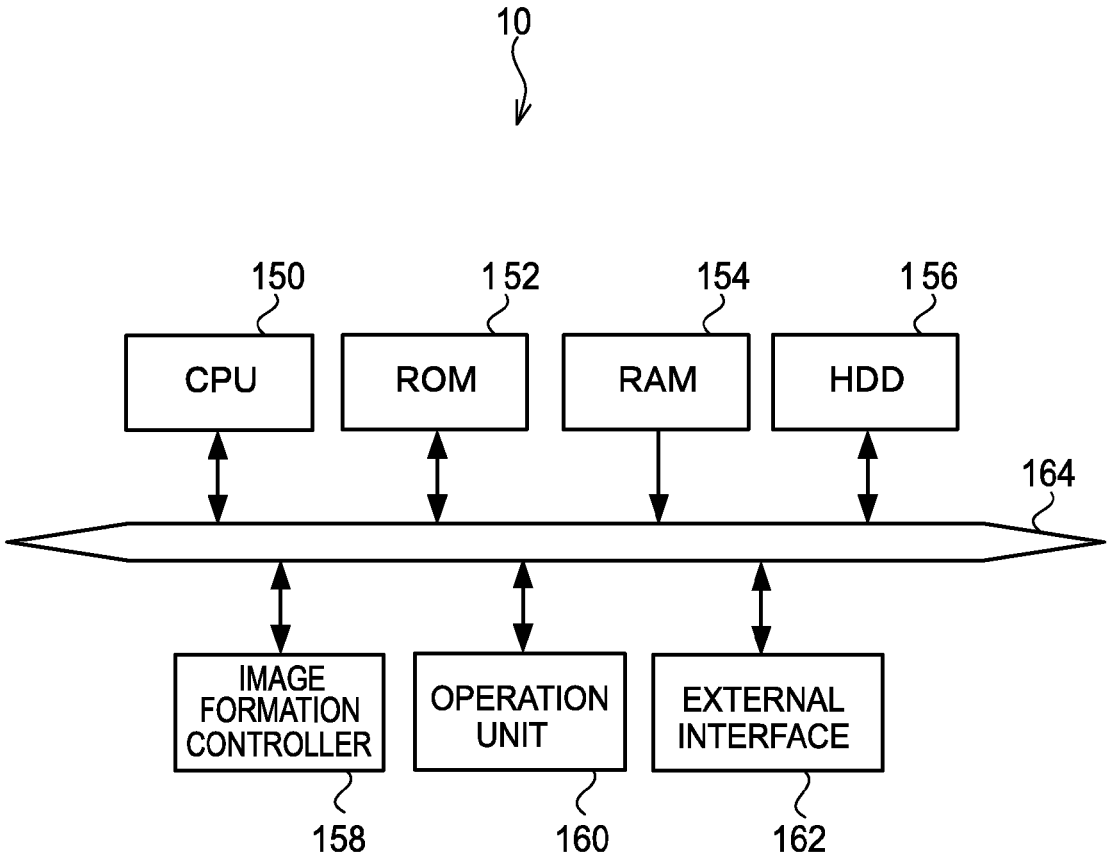
FIG. 5 is a block diagram showing the configuration of relevant portions of an electrical system of the image forming apparatus pertaining to the embodiment.

In FIG. 5, there is shown the configuration of relevant portions of an electrical system of the image forming apparatus 10 pertaining to the present embodiment.

The image forming apparatus 10 is equipped with a central processing unit (CPU) 150 that controls operation of the entire image forming apparatus 10, a read-only memory (ROM) 152 in which various programs, various parameters and various table information have been stored beforehand, a random access memory (RAM) 154 that is used as a work area and the like during execution of various programs by the CPU 150, and a hard disk drive (HDD) 156 that stores various information such as image information received via a later-described external interface 162.

Further, the image forming apparatus 10 is equipped with an image formation controller 158 that controls operation of the image forming unit 16, the ink drying unit 18, etc. when performing processing that forms an image based on the image information on the paper, an operation unit 160 that is disposed with operation buttons and a numerical keypad to which various operation instructions are inputted and a display for displaying various messages and the like, and an external interface 162 that transmits and receives various information such as image information to and from an external terminal device.

The CPU 150, the ROM 152, the RAM 154, the HDD 156, the image formation controller 158, the operation unit 160 and the external interface 162 are electrically interconnected via a system bus 164. Consequently, the CPU 150 accesses the ROM 152, the RAM 154 and the HDD 156, transmits and receives various information to and from the terminal device via the external interface 162, controls operation of the image forming unit 16, the ink drying unit 18, etc. via the image formation controller 158, and manages states of operation with respect to the operation unit 160 and display various messages and the like resulting from the operation unit 160.

The image forming apparatus 10 pertaining to the present embodiment executes ink liquid discharge processing that discharges the ink liquid inside the head module 85 at a predetermined timing (hereinafter called "the ink liquid discharge timing"). The image forming apparatus 10 pertaining to the present embodiment uses, as the ink liquid discharge timing, the timing when an instruction to perform periodic maintenance with respect to the inkjet line heads 64 is inputted; however, the timing is not limited to this timing. The image forming apparatus 10 may also use, as the ink liquid discharge timing, another timing such as the timing when power is supplied to the image forming apparatus 10, the timing when power is supplied to the image forming apparatus 10 after the image forming apparatus 10 has not been operated for a long period of time, or the timing when image quality defects arise in images that have been formed on the paper and a maintenance instruction is inputted by a user via the operation unit 160.

Figure 6:
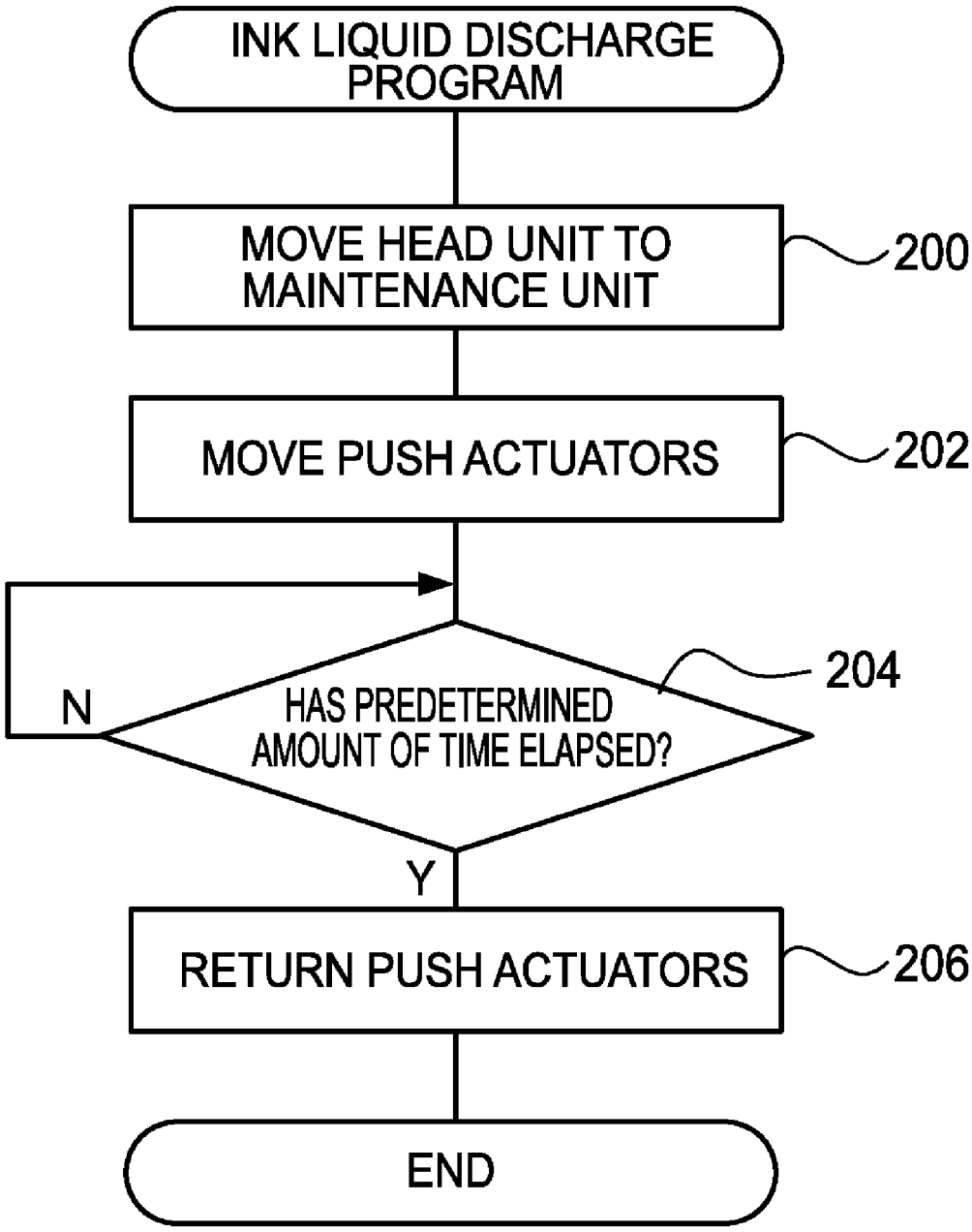
FIG. 6 is a flowchart showing a flow of processing by an ink liquid discharge program pertaining to the embodiment.

The action of the image forming apparatus 10 when executing the ink liquid discharge processing pertaining to the present embodiment will be described with reference to FIG. 6. FIG. 6 is a flowchart showing a flow of processing by an ink liquid discharge program that is executed by the CPU 150 when the ink liquid discharge timing is arrived at. The ink liquid discharge program is stored beforehand in a predetermined area of the ROM 152 serving as a storage medium.

In step 200, the head unit 66 is moved to the maintenance unit 80.

In step 202, the push actuators 112 is moved in the direction of the ink storage units 110 and operation of the pumps 94A and 94B stops via the image formation controller 158.

Because of the movement of the push actuators 112, the push actuators 112 apply the external force to the deforming portions 110A of the ink storage units 110. For that reason, the ink liquid inside the head modules 85 is discharged from the nozzles 82 together with the ink liquid being stored inside the ink storage units 110.

Because of the application of the external force by the push actuators 112, the pressure of the ink liquid inside the ink storage units 110 and the head modules 85 becomes higher in comparison to when the external force is not being applied. For that reason, the circulation limiting valves 108A and 108B become closed. Because the circulating limiting valves 108A and 108B become closed, the ink liquid is prevented from flowing toward the ink tank 90 via the supply channel 92, the ink liquid is prevented from flowing toward the ink tank 90 via the return channel 102, and the ink liquid is prevented from flowing into other head modules 85 via the ink supply manifold 100 or the ink recovery manifold 106.

The amount of the ink liquid that is jetted from the nozzles 82 because of the application of the external force by the push actuators 112 is larger than the amount of the ink liquid that is jetted as a result of driving the actuators 88. For that reason, ink liquid in which there are air bubbles and the like can be forcibly discharged from the head modules 85. The ink liquid that has been jetted from the nozzles 82 is collected in the waste solution tray (not shown) with which the maintenance unit 80 is equipped.

In step 204, it is in a wait state until a predetermined amount of time elapses.

The predetermined amount of time is an amount of time in which the pressure of the ink liquid inside the ink storage units 110 that has risen as a result of the external force being applied by the push actuators 112 falls as a result of the ink liquid being jetted from the nozzles 82. This amount of time is experimentally determined beforehand. That is, the pressure inside the ink storage units 110 remains high until the predetermined amount of time elapses. The ink liquid continues to be discharged from the nozzles 82. The circulation limiting valves 108A close the branching channels 91 and the circulation limiting valves 108B close the discharge channels 101. When the predetermined amount of time is reached, the pressure inside the ink storage units 110 is mitigated. The discharge of ink droplets from the nozzles 82 stops. The circulation limiting valves 108A open the branching channels 91 and the circulation limiting valves 108B open the discharge channels 101.

In step 206, the push actuators 112 is returned to their original positions and the pumps 94A and 94B restarts operation via the image formation controller 158, and then the program ends.

Because of the above-described operation (pressure purge operation) by which the push actuators 112 cause the ink liquid to be jetted from the nozzles 82, unwanted ink liquid inside the head modules 85 is jetted from the nozzles 82 and sudden pressure changes inside the head modules 85 are prevented. For that reason, the insides of the head modules 85 can be filled with new ink liquid without drawing in air bubbles.

As described in detail above, according to the liquid droplet jetting apparatus pertaining to the present embodiment included in the image forming apparatus 10, the image forming apparatus 10 is equipped with: the jetting unit 86 equipped with the plural head modules 85, each of which includes the plural pressure chambers 84 that jet the supplied ink liquid from the nozzles 82 in response to applied pressure; and the supply channel 92 equipped with the plural branching channels 91 that supply, to each of the head modules 85, the ink liquid that is stored in the ink tank 90 that stores the ink liquid. Circulation of the ink liquid in the direction from the ink tank 90 to the head modules 85 is allowed and circulation of the ink liquid in the opposite direction of the circulating direction is limited by the circulation limiting valves 108A that are disposed in each of the plural branching channels 91. The ink liquid is stored by the ink storage units 110 that are disposed between the circulation limiting valves 108A in each of the plural branching channels 91 and the head modules 85 and whose volumes change because of external force. The external force is applied by the push actuators 112 to the ink storage units 110 such that the volumes of the ink storage units 110 become smaller, and ink droplets are jetted from the nozzles 82 of the plural pressure chambers 84. In this manner, the image forming apparatus 10 can perform maintenance to discharge liquid into which air bubbles and foreign matter have become mixed for each head module with a simple configuration.

The circulation limiting valves 108A are equipped with the valve bodies 120 that open and close the branching channels 91 and the energizing members 122 that energize the valve bodies 120 in the direction in which the valve bodies 120 open the branching channels 91. The valve bodies 120 close the branching channels 91 when the ink liquid tries to circulate in the opposite direction of the open direction counter to the energizing force of the energizing members 122. The image forming apparatus 10 can, with a simple configuration using the pressure of the ink liquid that tries to flow upstream in the supply channel, prevent the ink liquid from flowing upstream in the supply channel as a result of the external force being applied to the ink storage units 110.

The plural discharge channels 101, through which the ink liquid that has been discharged from the head modules 85 circulates, are communicated with the return channel 102, and the return channel 102 allows the ink liquid that has been supplied to each of the head modules 85 to return to the ink tank 90. The circulation limiting valves 108B are disposed in each of the plural discharge channels 101 and limit circulation of the liquid in the direction from the head modules 85 to the ink tank 90 when the external force is applied to the ink storage units 110 by the push actuators 112. Thus, the image forming apparatus 10 can cause the ink liquid inside the head modules 85 that has not been jetted from the nozzles 82 to circulate. The image forming apparatus 10 can prevent the ink liquid from flowing into other head modules 85 via the return channel 102 when the external force is applied to the ink storage units 110.

The circulation limiting valves 108B are equipped with the valve bodies 120 that open and close the discharge channels 101 and the energizing members 122 that energize the valve bodies 120 in the direction in which the valve bodies 120 open the discharge channels 101. The valve bodies 120 close the discharge channels 101 when the ink liquid tries to circulate through the discharge channels 101 with pressure that is stronger than the energizing force of the energizing members 122. The image forming apparatus 10 can, with a simple configuration using the pressure of the ink liquid that tries to flow downstream in the return channel, prevent the ink liquid from flowing into other head modules 85 via the return channel 102 as a result of the external force being applied to the ink storage units 110.

The ink storage units 110 have parts that are flexible, and the push actuators 112 apply the external force to those parts of the ink storage units 110. The image forming apparatus 10 can change the volumes of the ink storage units 110 with a simple configuration.

The push actuators 112 continue to apply the external force to the ink storage units 110 for the predetermined amount of time in order to cause the ink liquid to be jetted from the nozzles 82. The image forming apparatus 10 can more reliably jet the ink liquid inside the head modules 85 from the nozzles 82.

The invention has been described above using the preceding embodiment, but the technical scope of the invention is not limited to the scope described in the preceding embodiment. Various changes or improvements can be made to the preceding embodiment within a scope that does not depart from the gist of the invention, and embodiments to which such changes or improvements have been made are also included in the technical scope of the invention.

The preceding embodiment is not intended to limit the inventions set forth in the claims, and not all combinations of the features described in the preceding embodiment are necessary for the solving means of the invention. Various stages of inventions are included in the preceding embodiment, and various inventions can be extracted by combinations of the plural configural requirements that are disclosed. Even if several configural requirements are deleted from all of the configural requirements described in the preceding embodiment, configurations from which those several configural requirements have been deleted may also be extracted as inventions as long as effects are obtained.

Figure 7:
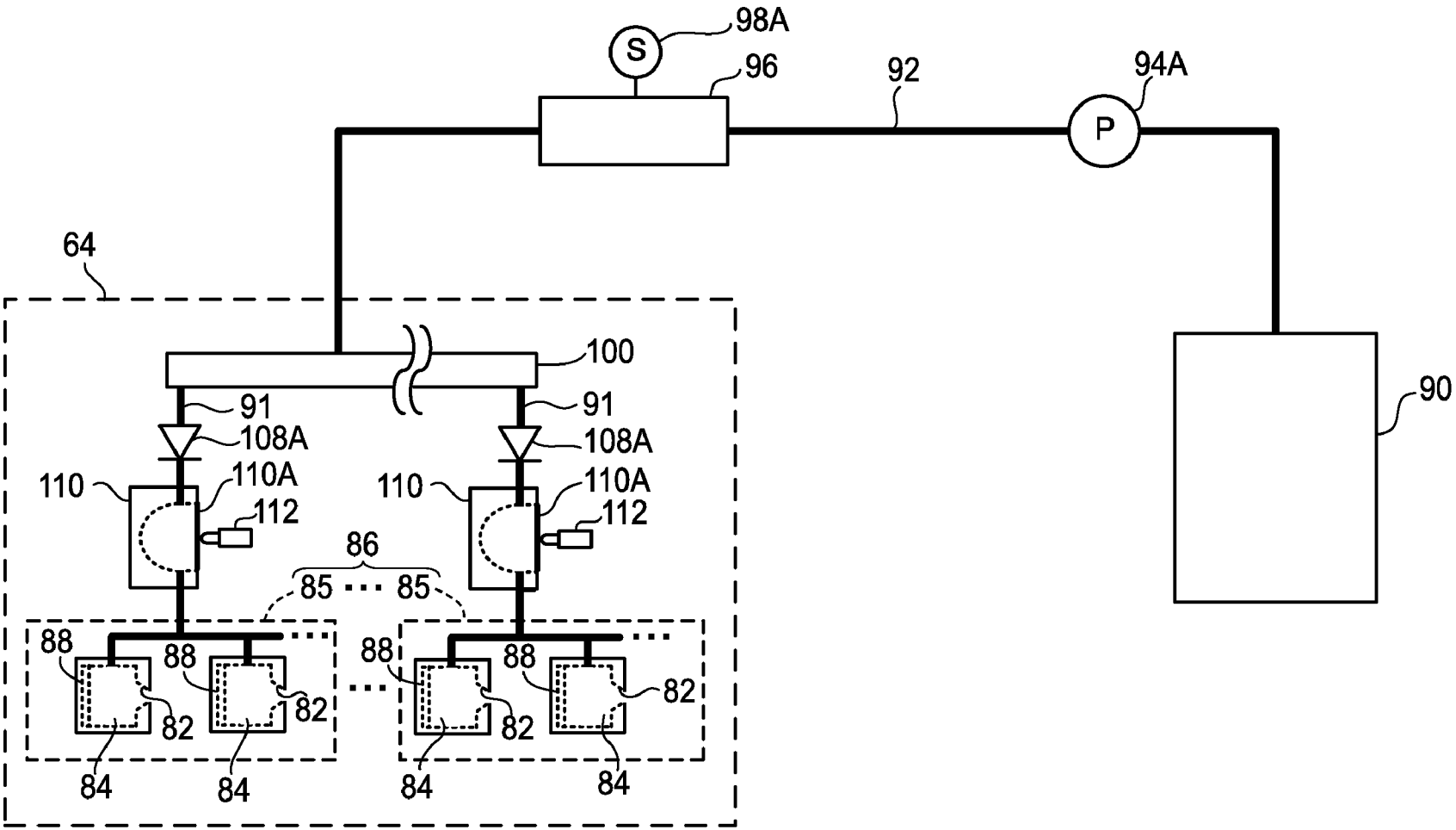
FIG. 7 is a schematic diagram showing the configuration of an inkjet line head pertaining to a modification of the embodiment and a flow channel for ink liquid that is supplied from an ink tank to the inkjet line head.

In the preceding embodiment, a case has been described where the image forming apparatus 10 is equipped with the return channel 102, but the invention is not limited to this. For example, as shown in FIG. 7, the image forming apparatus 10 may also be configured such that it is not equipped with the return channel 102.

In the preceding embodiment, a case has been described where the external force applying units of the present invention are configured by the push actuators 112 that move by solenoids, but the present invention is not limited to this. The external force applying units may also be configured by push members that move by motors where eccentric cams are disposed on rotating shafts. In the case of this configuration, the push members move to positions where they apply the external force to the deforming portions 110A of the ink storage units 110 when the push members contact the portions of the eccentric cams whose radius is large, and the push members move to positions where they do not apply the external force to the deforming portions 110A of the ink storage units 110 when the push members contact the portions of the eccentric cams whose radius is small.

In the preceding embodiment, a case has been described where the ink storage units 110 have parts that are flexible and where the external force is applied to those parts, but the present invention is not limited to this. The ink storage units 110 may also be configured such that the entireties of the ink storage units 110 are flexible so that, for example, the volumes of the ink storage units 110 are changed by applying the external force to two opposing places of the ink storage units 110 so as to sandwich the ink storage units 110.

In the preceding embodiment, a case has been described where the push actuators 112 which are the external force applying units of the present invention are configured to be movable and where the push actuators 112 move toward the ink storage units 110, but the present invention is not limited to this. For example, the invention may also be configured such that the ink storage units 110 are configured to be movable and such that the ink storage units 110 move toward the push actuators 112.

In the preceding embodiment, a case has been described where the circulation limiting valves 108A and 108B are structured such that they are equipped with the valve bodies 120 that open and close the flow channels and the energizing members 122 that energize the valve bodies 120 in the direction in which the valve bodies 120 open the flow channels, but the present invention is not limited to this. For example, the circulation limiting valves 108A and 108B may also be configured by electromagnetic valves or other valves. When the circulation limiting valves 108A and 108B are configured by electromagnetic valves, the opening and closing of the electromagnetic valves is controlled in response to the movement of the push actuators 112.

The configuration of the image forming apparatus 10 described in the preceding embodiment (see FIG. 1 to FIG. 5) is only one example, and unnecessary portions may be deleted and new portions may be added within a scope that does not depart from the gist of the present invention.

The flow of processing by the ink liquid discharge program described in the preceding embodiment (see FIG. 6) is also only one example, and it goes without saying that unnecessary steps may be deleted, new steps may be added, and the processing order may be switched within a scope that does not depart from the gist of the invention.

According to a first aspect of the present invention, there is provided a liquid droplet jetting apparatus comprising: a jetting unit equipped with plural head modules, each of the plural head modules including plural nozzles that jet liquid droplets and plural pressure chambers that jet a supplied liquid from the nozzles in response to applied pressure; a supply channel equipped with plural branching channels that supply, to each of the plural head modules, liquid that is stored in a storage chamber that stores the liquid; first circulation limiting units that are disposed in each of the plural branching channels, that allow circulation of the liquid in a direction from the storage chamber to the plural head modules and that limit circulation of the liquid in an opposite direction of the circulating direction; liquid storage units that are disposed between the circulation limiting units in each of the plural branching channels and the plural head modules, that store the liquid, and whose volumes change because of external force; and external force applying units that apply the external force to the liquid storage units, such that the volumes of the liquid storage units become smaller, and that cause liquid droplets to be jetted from the nozzles.

According to the first aspect, the liquid storage units whose volumes change because of the external force are disposed for each of the head modules that include the plural pressure chambers, and liquid droplets are jetted from the nozzles of the plural pressure chambers when the external force is applied to the liquid storage units. Thus, the liquid droplet jetting apparatus can perform maintenance to discharge liquid into which air bubbles and foreign matter have become mixed for each head module with a simple configuration.

According to a second aspect of the present invention, in the first aspect, the circulation limiting units may have valve bodies that open and close the branching channels and energizing units that energize the valve bodies in a direction in which the valve bodies open the branching channels, with the valve bodies closing the branching channels when the liquid tries to circulate in the opposite direction counter to the energizing force of the energizing units.

Thus, the liquid droplet jetting apparatus can, with a simple configuration, prevent the liquid from flowing upstream in the supply channel as a result of the external force being applied to the liquid storage units.

According to a third aspect of the present invention, in the first aspect, the liquid droplet jetting apparatus may further include: a return channel with which plural discharge channels, through which the liquid that has been discharged from the plural head modules circulates, are communicated and which allows the liquid that has been supplied to each of the plural head modules to return to the storage chamber; and second circulation limiting units that are disposed in each of the plural discharge channels and limit circulation of the liquid in a direction from each of the plural head modules to the storage chamber when the external force is being applied to the liquid storage units by the external force applying units.

Thus, the liquid droplet jetting apparatus can cause the liquid inside the head modules that has not been jetted from the nozzles to circulate. Further, the liquid droplet jetting apparatus can prevent the liquid from flowing into other head modules via the return channel when the external force is applied to the liquid storage units.

According to a fourth aspect of the present invention, in the third aspect, the second circulation limiting units may have valve bodies that open and close the discharge channels and energizing units that energize the valve bodies in a direction in which the valve bodies open the discharge channels, and the valve bodies close the discharge channels when the liquid tries to circulate through the discharge channels with pressure that is stronger than the energizing force of the energizing units.

Thus, the liquid droplet jetting apparatus can, with a simple configuration, prevent the liquid from flowing into other head modules via the return channel as a result of the external force being applied to the liquid storage units.

According to a fifth aspect of the present invention, in the first aspect, the liquid storage units may have parts that are flexible, and the external force applying units may apply the external force to the parts of the liquid storage units.

Thus, the liquid droplet jetting apparatus can change the volume of the liquid storage units with a simple configuration.

According to a sixth aspect of the present invention, in the first aspect, the external force applying units may continue to apply the external force to the liquid storage units for a predetermined amount of time in order to cause liquid droplets to be jetted from the nozzles.

Thus, the liquid droplet jetting apparatus can more reliably jet the liquid inside the head modules from the nozzles.

As described above, according to the present invention, a liquid droplet jetting apparatus equipped with plural head modules can perform maintenance to discharge liquid into which air bubbles and foreign matter have become mixed for each head module with a simple configuration.

An embodiment of the present invention is described above, but the present invention is not limited to the embodiment as will be clear to those skilled in the art.

What is claimed is:

1. A liquid droplet jetting apparatus comprising:

a jetting unit equipped with plural head modules, each of the plural head modules including plural nozzles that jet liquid droplets and plural pressure chambers that jet a supplied liquid from the nozzles in response to applied pressure;

a supply channel equipped with plural branching channels that supply, to each of the plural head modules, liquid that is stored in a storage chamber that stores the liquid;

first circulation limiting units that are disposed in each of the plural branching channels, that allow circulation of the liquid in a direction from the storage chamber to the plural head modules and that limit circulation of the liquid in an opposite direction of the circulating direction;

liquid storage units that are disposed between the circulation limiting units in each of the plural branching channels and the plural head modules, that store the liquid, and whose volumes change because of external force; and external force applying units that apply the external force to the liquid storage units such that the volumes of the liquid storage units become smaller, and that cause liquid droplets to be jetted from the nozzles.

2. The liquid droplet jetting apparatus according to claim 1, wherein the first circulation limiting units have valve bodies that open and close the branching channels and energizing units that energize the valve bodies in a direction in which the valve bodies open the branching channels, and the valve bodies close the branching channels when the liquid tries to circulate in the opposite direction counter to the energizing force of the energizing units.

3. The liquid droplet jetting apparatus according to claim 1, further comprising:

a return channel with which plural discharge channels, through which the liquid that has been discharged from the plural head modules circulates, are communicated and which allows the liquid that has been supplied to each of the plural head modules to return to the storage chamber; and second circulation limiting units that are disposed in each of the plural discharge channels and limit circulation of the liquid in a direction from each of the plural head modules to the storage chamber when the external force is being applied to the liquid storage units by the external force applying units.

4. The liquid droplet jetting apparatus according to claim 3, wherein the second circulation limiting units have valve bodies that open and close the discharge channels and energizing units that energize the valve bodies in a direction in which the valve bodies open the discharge channels, and the valve bodies close the discharge channels when the liquid tries to circulate through the discharge channels with pressure that is stronger than the energizing force of the energizing units.

5. The liquid droplet jetting apparatus according to claim 1, wherein the liquid storage units have parts that are flexible, and the external force applying units apply the external force to the parts of the liquid storage units.

6. The liquid droplet jetting apparatus according to claim 1, wherein the external force applying units continue to apply the external force to the liquid storage units for a predetermined amount of time in order to cause liquid droplets to be jetted from the nozzles.

7. An image forming apparatus comprising:

a liquid droplet jetting apparatus comprising:

a jetting unit equipped with plural head modules, each of the plural head modules including plural nozzles that jet liquid droplets and plural pressure chambers that jet a supplied liquid from the nozzles in response to applied pressure;

a supply channel equipped with plural branching channels that supply, to each of the plural head modules, liquid that is stored in a storage chamber that stores the liquid;

circulation limiting units that are disposed in each of the plural branching channels, that allow circulation of the liquid in a direction from the storage chamber to the plural head modules and that limit circulation of the liquid in an opposite direction of the circulating direction;

liquid storage units that are disposed between the circulation limiting units in each of the plural branching channels and the plural head modules, that store the liquid, and whose volumes change because of external force; and external force applying units that apply the external force to the liquid storage units such that the volumes of the liquid storage units become smaller, and that cause liquid droplets to be jetted from the nozzles.

* * * * *